US008720797B2

(12) United States Patent
Yamasaki et al.

(10) Patent No.: US 8,720,797 B2
(45) Date of Patent: May 13, 2014

(54) ROTARY ATOMIZING HEAD, ROTARY ATOMIZATION COATING APPARATUS, AND ROTARY ATOMIZATION COATING METHOD

(75) Inventors: Isamu Yamasaki, Toyota (JP); Atsuo Nabeshima, Toyota (JP); Michio Mitsui, Yokohama (JP); Toshio Hosoda, Yokohama (JP)

(73) Assignees: Toyota Jidosha Kabushiki Kaisha, Toyota-shi, Aichi-ken (JP); Ransburg Industrial Finishing K.K., Yokohama-shi, Kanagawa-ken (JP)

( * ) Notice: Subject to any disclaimer, the term of this patent is extended or adjusted under 35 U.S.C. 154(b) by 802 days.

(21) Appl. No.: 12/601,044

(22) PCT Filed: May 23, 2008

(86) PCT No.: PCT/JP2008/060088

§ 371 (c)(1),
(2), (4) Date: Nov. 20, 2009

(87) PCT Pub. No.: WO2008/146926

PCT Pub. Date: Dec. 4, 2005

(65) Prior Publication Data

US 2010/0155504 A1 Jun. 24, 2010

(30) Foreign Application Priority Data

May 24, 2007 (JP) ..... 2007-138445
Jul. 26, 2007 (JP) ..... 2007-194772

(51) Int. Cl.

| | |
|---|---|
| ***B05B 3/02*** | (2006.01) |
| ***F23D 11/04*** | (2006.01) |
| ***B05B 3/10*** | (2006.01) |
| ***B44D 5/10*** | (2006.01) |
| ***B05B 5/00*** | (2006.01) |

(52) U.S. Cl.
USPC ..... 239/223; 239/214; 239/214.25; 239/222; 239/222.11; 239/703

(58) Field of Classification Search
USPC ..... 239/214, 214.25, 215, 216, 222, 239/222.11, 223, 552, 568, 596, 703
See application file for complete search history.

(56) References Cited

U.S. PATENT DOCUMENTS 4,919,333 A * 4/1990 Weinstein ..... 239/223
4,943,005 A * 7/1990 Weinstein ..... 239/223

(Continued)

FOREIGN PATENT DOCUMENTS

| | | |
|---|---|---|
| EP | 1 825 921 A1 | 8/2007 |
| JP | 55-11064 | 1/1980 |
| JP | 6-12836 | 4/1994 |
| JP | 8-24720 | 1/1996 |
| JP | 11-123349 | 5/1999 |
| JP | 2000-288430 | 10/2000 |

(Continued)

*Primary Examiner* — Ryan Reis
(74) *Attorney, Agent, or Firm* — Finnegan, Henderson, Farabow, Garrett & Dunner, LLP

(57) ABSTRACT

A rotary atomizing head 1, which has an inner peripheral surface 2 whose diameter increases from a bottom 21 of the inner peripheral surface toward a tip thereof, and atomizes and releases paint by applying a centrifugal force generated by rotation to the paint supplied to the bottom of the inner peripheral surface, includes a paint supply nozzle 11 for supplying the paint and a cleaning solution to the bottom of the inner peripheral surface, and the paint supply nozzle has a nozzle hole 10*a* for discharging the paint and the cleaning solution from a rotation center O portion of the rotary atomizing head in a direction substantially perpendicular to a rotation axis of the rotary atomizing head. The rotary atomizing head 1 also includes a dam portion 4 that is provided in an intermediate portion between the bottom and the tip of the inner peripheral surface and dams the paint and the cleaning solution supplied from the paint supply nozzle to the bottom and flow along the inner peripheral surface toward the tip.

5 Claims, 7 Drawing Sheets

(56) References Cited

U.S. PATENT DOCUMENTS

| | | | | |
|---|---|---|---|---|
| 6,056,215 | A * | 5/2000 | Hansinger et al. | 239/703 |
| 6,341,734 | B1 * | 1/2002 | Van Der Steur | 239/223 |
| 2003/0010841 | A1 * | 1/2003 | Kon | 239/224 |
| 2007/0290081 | A1 | 12/2007 | Murai et al. | |

FOREIGN PATENT DOCUMENTS

| | | |
|---|---|---|
| JP | 2002-224611 | 8/2002 |
| JP | 2006-130423 | 5/2006 |
| JP | 2007-7506 | 1/2007 |
| WO | WO 2006/049341 A1 | 5/2006 |

* cited by examiner

FIG. 11

| CATEGORY | PASSAGE BORE DIAMETER (mm) | NUMBER OF PASSAGES | TOTAL EFFECTIVE SECTIONAL AREA S ($mm^2$) | PITCH CIRCLE DIAMETER D (mm) | S/D RATIO |
|---|---|---|---|---|---|
| INVENTION 1 | 0.2 | 400 | 12.56 | 57 | 0.220 |
| INVENTION 2 | 0.2 | 300 | 9.42 | 37 | 0.255 |
| COMPARATIVE EXAMPLE 1 | 1.5 | 40 | 70.65 | 24 | 2.943 |
| REFERENCE EXAMPLE 1 | 1.0 | 90 | 70.65 | 48 | 1.472 |
| REFERENCE EXAMPLE 2 | 0.8 | 45 | 30.14 | 21 | 1.415 |

ROTARY ATOMIZING HEAD, ROTARY ATOMIZATION COATING APPARATUS, AND ROTARY ATOMIZATION COATING METHOD

This application is a national phase application of International Application No. PCT/JP2008/060088, filed May 23, 2008, and claims the priority of Japanese Application Nos. 2007-138445, filed May 24, 2007, and 2007-194772, filed Jul. 26, 2007, the contents of all of which are incorporated herein by reference.

TECHNICAL FIELD

The present invention relates to a rotary atomizing head, rotary atomization coating apparatus, and a rotary atomization coating method for performing electrostatic coating.

BACKGROUND ART

A rotary atomization coating apparatus, which is conventionally known in the art, is structured so that a rotary atomizing head, which has a bell-shaped inner peripheral surface whose diameter increases from the bottom toward the tip, is rotatably mounted to a coating apparatus main body, and a centrifugal force generated by rotation is applied to paint supplied to the bottom of the inner peripheral surface of the rotary atomizing head that is rapidly rotating, thereby atomizing the paint and releasing the atomized paint.

Such rotary atomization coating apparatus performs coating of the surface of an object to be coated, by applying an electrostatic high voltage to the rotary atomizing head to charge minute particles of the atomized paint, and spraying the charged paint particles toward the object by an electrostatic field formed between the rotary atomizing head to which the electrostatic high voltage has been applied and the grounded object.

An example of the rotary atomization coating apparatus having such a structure is a coating apparatus described in Patent Document 1.

As shown in, e.g., FIG. 9, a rotary atomizing head included in such a rotary atomization coating apparatus is structured as a rotary atomizing head 101 having an inner peripheral surface 102 formed in a bottomed bell shape, and a hub portion 104, which closes a paint reservoir chamber 102*a* formed at the bottom of the inner peripheral surface 102, is formed on the inner peripheral surface 102.

A through hole 103 is formed in the bottom of the paint reservoir chamber 102*a*, and a paint supply tube 110 is inserted in the through hole 103 so that paint is supplied from the paint supply tube 110 into the paint reservoir chamber 102*a*.

A plurality of paint supply holes 104*a* are formed in a boundary portion of the hub portion 104 with the inner peripheral surface 102, and a paint path 102*b* is formed in a portion of the inner peripheral surface 102, which is located on the tip side (on the left side in FIG. 9) of the hub portion 104.

Moreover, a cleaning hole 104*b* is formed in a central part of the hub portion 104, and a protruding portion 104*c* protruding in a substantially cone shape, and a paint path 104*d* from the protruding portion 104*c* toward the paint supply holes 104*a* are formed on the surface of the paint reservoir chamber 102*a* side of the central part.

When the paint is supplied into the paint reservoir chamber 102*a* in the state where the rotary atomizing head 101 structured as described above is being rotated at a high speed by an air motor or the like included in the rotary atomization coating apparatus, the supplied paint strikes the protruding portion 104*c*, and then, flows toward the outer periphery along the paint path 104*d* of the hub portion 104 by a centrifugal force generated by the rotation.

In this case, the paint striking the protruding portion 104*c* has relatively high viscosity, and thus, does not flow through the cleaning hole 104*b* toward the tip, but flows toward the outer periphery along the paint path 104*d* of the hub portion 104.

The paint, which has flown toward the outer periphery, flows to the paint path 102*b* through the paint supply holes 104*a*.

Moreover, a paint releasing end 102*c* formed at the tip of the inner peripheral surface 102 has a multiplicity of serrations, and the paint, which has flown to the flow path 102*b*, turns into liquid ligaments at the paint releasing end 102*c*, and then, is released from the tip of the inner peripheral surface 102 as the liquid ligaments. The released paint in the form of the liquid ligaments are atomized and sprayed.

In this case, the paint particles released from the paint releasing end 102*c* try to spread toward the outer periphery by the centrifugal force. Thus, in the rotary atomization coating apparatus, shaping air 120*a* is blown from a shaping cap 120, which is disposed around the rotary atomizing head 101, toward a coating direction to control the spraying direction of the paint particles so that the paint particles are sprayed along a coating pattern 130.

Moreover, the rotary atomization coating apparatus is capable of supplying a cleaning solution from the paint supply tube 110 into the paint reservoir chamber 102*a* to clean the paint adhering to the inner peripheral surface 102 and the like with the supplied cleaning solution.

Moreover, in recent years, it has been desired to increase the paint discharge amount from one rotary atomization coating apparatus, due to demands for improved efficiency of the coating operation, and the like. However, increasing the paint discharge amount from the rotary atomizing head 101 increases the diameter of the paint that is discharged in the form of the liquid ligaments. This makes it difficult to make minute paint particles, which may affect the coating quality.

That is, in coating lines of automotive bodies and the like, it is common that a plurality of coating robots, each holding the above coating machine, are installed along the coating line so that automotive bodies and the like, which are transferred at a predetermined speed on the coating line, are coated with the paint a plurality of times by the plurality of coating robots. In order to reduce the coating cost in such coating lines, it is effective to reduce the number of times the automotive bodies are coated to reduce the number of coating robots to be installed, and to increase the transfer speed to reduce the coating time. However, these methods to reduce the coating cost cannot be implemented without increasing the paint discharge amount from the rotary atomizing heads.

However, in a mechanism of atomizing paint by the rotary atomization coating apparatuses, as shown in FIG. 10, atomization proceeds as liquid ligaments 300 released through V grooves 102*d* formed at an open end (the paint releasing end) of the rotary atomizing head 101 are divided. Thus, increasing only the paint discharge amount from the rotary atomizing head 101 increases the thickness of the liquid ligaments 300. This makes it difficult to atomize the paint, thereby degrading the coating film quality.

Thus, in the case of increasing the paint discharge amount, it is necessary to increase also the rotational speed of the rotary atomizing head to increase the paint releasing rate. However, increasing the rotational speed of the rotary atomizing head causes significant disturbance in the liquid ligaments 300, thereby increasing a variation in particle size distribution of atomized coating particles. That is, the particle size distribution varies from a very minute particle region of a very small particle size to a coarse particle region of a large particle size. Thus, the coating efficiency is reduced if there is a large amount of coating particles in the very minute particle region, and the coating film quality is degraded if there is a large amount of coating particles in the coarse particle region. Moreover, increasing the rotational speed of the rotary atomizing head increases the amount of atomized coating particles that are sprayed to a region around the rotary atomizing head. Thus, the pressure of the shaping air needs to be increased, which increases the amount of coating particles bouncing from the surface of an object to be coated, further reducing the coating efficiency.

Note that, for example, in a coating machine described in Patent Document 2, an annular dam (a dam portion) is provided on the inner surface of a bell cup (a rotary atomizing head) to temporarily accumulate paint therein, and the paint that overflows from the annular dam is caused to flow to a paint releasing end as a uniform thick liquid film, so that the paint can be atomized even if the paint supply amount is large. However, in this case as well, the thickness of liquid ligaments 3 (FIG. 4) increases with an increase in the paint supply amount. Thus, the rotational speed of the rotary atomizing head needs to be increased, which causes similar problems to those described above. Thus, this coating machine provides no fundamental solution.

Patent Document 1: Japanese Examined Utility Model Application Publication No. JP-Y-H06-12836

Patent Document 2: Japanese Patent Application Publication No. JP-A-2007-7506

DISCLOSURE OF THE INVENTION

Problem to be Solved by the Invention

As described above, in the rotary atomization coating apparatus for performing coating by releasing paint particles from the rotary atomizing head 101, the space surrounded by the released paint particles has a negative pressure, whereby an accompanying flow 140 is generated in the direction from the tip side of the rotary atomizing head 101 toward the hub portion 104. Thus, the released paint particles move with the accompanying flow, and adhere to the tip-side surface (the surface on the left side in FIG. 9) of the hub portion 104, whereby the tip-side surface of the hub portion 104 is stained.

The rotary atomizing paint apparatus is structured to supply the cleaning solution into the paint reservoir chamber 102*a* to clean the inner peripheral surface 102 and the like as described above, and is also capable of cleaning the stain on the tip-side surface of the hub portion 104.

That is, the cleaning solution supplied into the paint reservoir chamber 102*a* leaks to the tip-side surface of the hub portion 104 through the cleaning hole 104*b* formed in the center of the hub portion 104, and flows from the center of the tip-side surface toward the outer periphery thereof by the centrifugal force generated by rotation of the rotary atomizing head 101. This cleaning solution cleans the adhering paint as the cleaning solution flows from the center of the tip-side surface of the hub portion 104 toward the outer periphery thereof.

However, the cleaning hole 104*b* needs to be formed so as to have a diameter that is not large enough to allow the paint having relatively high viscosity to pass therethrough, but is large enough to allow the cleaning solution having relatively low viscosity to pass therethrough. Thus, the cleaning hole 104*b* cannot be formed with a very large diameter. Thus, the amount of cleaning solution to be supplied to the tip-side surface of the hub portion 104 cannot be significantly increased.

On the other hand, the stain adhering to the tip-side surface of the hub portion 104 gradually dries during coating operation, and thus, is less likely to be removed by cleaning operation that is performed after the coating operation is finished.

Thus, it takes a long time to remove the paint adhering to the tip-side surface of the hub portion 104, making the cleaning operation burdensome.

Thus, the present invention provides a rotary atomizing head, a rotary atomization coating apparatus, and a rotary atomization coating method, which are capable of easily cleaning adhering paint, and are also capable of making minute particles of paint even when the discharge amount is large, ensuring high coating quality.

Means for Solving the Problem

A rotary atomizing head and a rotary atomization coating apparatus, which solve the above problems, have the following characteristics.

That is, as described in claim 1, a rotary atomizing head that has an inner peripheral surface whose diameter increases from a bottom of the inner peripheral surface toward a tip thereof, and atomizes and releases paint by applying a centrifugal force generated by rotation to the paint supplied to the bottom of the inner peripheral surface includes: a paint supply nozzle for supplying the paint and a cleaning solution to the bottom of the inner peripheral surface, wherein the paint supply nozzle has a nozzle hole for discharging the paint and the cleaning solution from a rotation center portion of the rotary atomizing head in a direction substantially perpendicular to a rotation axis of the rotary atomizing head; a dam portion that is provided in an intermediate portion between the bottom and the tip of the inner peripheral surface, and dams the paint and the cleaning solution supplied from the paint supply nozzle to the bottom and flow along the inner peripheral surface toward the tip, wherein the dam portion is formed in an annular shape along a circumferential direction of the inner peripheral surface and also has an annular wall body where the wall surface of the annular wall body is adapted to correspond with a plane that is orthogonal to an axis of the rotary atomizing head; and a plurality of paint supply holes formed in the circumferential direction in a boundary portion of the dam portion with the inner peripheral surface.

Thus, no hub portion, which is a portion where paint particles adhering thereto dry, need be provided as in conventional examples, and a bottom-side paint path where the paint constantly flows is the portion to which the paint particles adhere near the bottom of the inner peripheral surface.

Thus, the paint adhering to the inner peripheral surface of the rotary atomizing head can be easily cleaned and removed in the entire region. Further, since the dam portion has the annular wall body where the wall surface of the annular wall body is adapted to correspond with a plane that is orthogonal to an axis of the rotary atomizing head, the paint flown over from the dam portion can be suppressed whereby the paint can be mainly accumulated at the dam portion.

Moreover, in the case of releasing the paint from the rotary atomizing head, the paint is released at a higher speed, as compared to the case where the paint is released without being accumulated in the dam portion. Thus, the diameter of the paint that is released in the form of liquid ligaments can be reduced, whereby high minuteness of the sprayed paint can be achieved.

Thus, even if the paint discharge amount from the rotary atomizing head is increased, the sprayed paint particles can be reduced to minute particles, whereby the coating quality can be improved.

Moreover, as described in claim 2, a rotary atomizing head that has an inner peripheral surface whose diameter increases from a bottom of the inner peripheral surface toward a tip thereof, and atomizes and releases paint by applying a centrifugal force generated by rotation to the paint supplied to the bottom of the inner peripheral surface includes: a hub portion that closes the bottom of the inner peripheral surface; a paint supply nozzle for supplying the paint and a cleaning solution to the bottom of the inner peripheral surface which is closed by the hub portion; a plurality of paint supply holes formed in a boundary portion of the hub portion with the inner peripheral surface; a dam portion that is formed in an intermediate portion between the hub portion and the tip, and dams the paint and the cleaning solution supplied to the bottom and flow along the inner peripheral surface toward the tip through the paint supply holes, where the dam portion is formed in an annular shape along a circumferential direction of the inner peripheral surface and also has an annular wall body where the wall surface of the annular wall body is adapted to correspond with a plane that is orthogonal to an axis of the rotary atomizing head; and a plurality of paint supply holes formed in the circumferential direction in a boundary portion of the dam portion with the inner peripheral surface. Further, since the dam portion has the annular wall body where the wall surface of the annular wall body is adapted to correspond with a plane that is orthogonal to an axis of the rotary atomizing head, the paint flown over from the dam portion can be suppressed whereby the paint can be mainly accumulated at the dam portion.

Thus, in the case of releasing the paint from the rotary atomizing head, the paint is released at a higher speed, as compared to the case where the paint is released without being accumulated in the dam portion. Thus, the diameter of the paint that is released in the form of liquid ligaments can be reduced, whereby high minuteness of the sprayed paint can be achieved.

Thus, even if the paint discharge amount from the rotary atomizing head is increased, the sprayed paint particles can be reduced to minute particles, whereby the coating quality can be improved.

Moreover, as described in claim 3, in a rotary atomization coating apparatus including the rotary atomizing head according to claim 1 or 2, respective amounts of the paint and the cleaning solution dammed by the dam portion in the rotary atomizing head are controlled by a rotational speed of the rotary atomizing head and respective supply amounts of the paint and the cleaning solution.

Thus, the discharge speed can be adjusted by controlling the liquid pressure of the paint accumulated in the dam portion, whereby the rotary atomization coating apparatus can be adapted to various coating usages.

Moreover, as described in claim 4, in a rotary atomization coating apparatus including the rotary atomizing head according to claim 1 or 2, respective amounts of the paint and the cleaning solution dammed by the dam portion in the rotary atomizing head are controlled by a rotational speed of the rotary atomizing head and respective supply amounts of the paint and the cleaning solution, and when the cleaning solution is supplied to the bottom of the inner peripheral surface, the rotational speed of the rotary atomizing head and the supply amount of the cleaning solution are controlled so that the cleaning solution dammed by the dam portion overflows from an inner peripheral edge of the dam portion toward the tip.

Thus, by normal cleaning operation in which the rotary atomizing head is drivingly rotated while supplying the cleaning solution from the paint supply nozzle, a large amount of cleaning solution is supplied to a tip-side surface of the dam portion, whereby the paint adhering to the tip-side surface of the dam portion can be easily cleaned and removed in a short period of time.

Moreover, the present invention is characterized in that, in a rotary atomization coating apparatus and a rotary atomization coating method for atomizing paint by rotating a rotary atomizing head at a high speed, an annular paint reservoir is provided on a paint passage surface of the rotary atomizing head in order to temporarily accumulate the paint therein, and the paint is discharged from a multiplicity of paint discharge passages provided in the paint reservoir.

In the rotary atomization coating apparatus and the rotary atomization coating method which are structured as described above, a liquid pressure is generated in the paint in the paint reservoir by a centrifugal force that is applied to the paint accumulated in the paint reservoir. The paint is discharged at a high speed from the paint discharge passages by this liquid pressure, and the paint releasing speed from the tip of the rotary atomizing head is also increased. Thus, an increase in thickness of liquid ligaments that are released from the tip of the rotary atomizing head can be suppressed even if the paint discharge amount is increased.

Exemplary Form of the Invention

Exemplary forms of the present invention will be shown below, and will be described with respect to each item.

(1) A rotary atomization coating apparatus for supplying paint from a paint feed tube to an inner bottom of a bell-cup shaped rotary atomizing head that receives a high voltage applied and rotates at a high speed, causing the paint to flow along an inner peripheral surface of a cup of the rotary atomizing head, and releasing the paint in an atomized form from a tip of the rotary atomizing head, is characterized by including: an annular dam portion that is provided on the inner peripheral surface of the cup of the rotary atomizing head and has an annular wall body where the wall surface of the annular wall body is adapted to correspond with a plane that is orthogonal to an axis of the rotary atomizing head, and also accumulates the paint flowing toward the tip of the rotary atomizing head; and a multiplicity of paint discharge passages provided in the dam portion so as to be evenly distributed in a circumferential direction (claim 5).

In the rotary atomization coating apparatus according to item (1), since the dam portion has the annular wall body where the wall surface of the annular wall body is adapted to correspond with a plane that is orthogonal to an axis of the rotary atomizing head, the paint flown over from the dam portion can be suppressed whereby the paint can be mainly accumulated at the dam portion. Further, a liquid pressure is generated in the paint in the dam by a centrifugal force that is applied to the paint accumulated in the dam portion. The paint is discharged at a high speed from the paint discharge passages by this liquid pressure, and the paint releasing speed from the tip of the rotary atomizing head is also increased. Thus, liquid ligaments that are released from the tip of the rotary atomizing head can be made to have a proper thickness even if the paint discharge amount is increased. As a result, atomization of the paint proceeds smoothly, whereby desired coating film quality is obtained. In this case, since the rotational speed of the rotary atomizing head is not increased, a variation in particle size distribution of atomized coating particles is suppressed. Moreover, since the pressure of shaping air need not be increased, coating efficiency is not degraded.

(2) The rotary atomization coating apparatus according to item (1) is characterized in that the paint discharge passages are provided in a joint portion between the annular wall body and the inner peripheral surface of the cup of the rotary atomizing head.

In the rotary atomization coating apparatus according to item (2), the paint discharge passages are provided in the joint portion between the annular wall body and the inner peripheral surface of the cup of the rotary atomizing head, that is, in a portion that corresponds to the bottom of the dam portion and where the centrifugal force acts the most. Thus, the paint is forced out at a high pressure from the paint discharge passages, and the paint discharge speed becomes sufficiently high.

(3) The rotary atomization coating apparatus according to item (1) or (2) is characterized in that a ratio S/D of a total effective sectional area S of the paint discharge passages provided in the dam portion to a diameter D of a pitch circle in which the paint discharge passages are arranged is set to 0.3 or less.

In the present invention, the paint discharge passages provided in the dam portion may have any bore diameter, and any number of paint discharge passages may be provided in the dam portion. However, in the case where the ratio S/D of the total effective sectional area S to the pitch circle diameter D is set to 0.3 or less as described in item (3), the paint discharge speed from the paint discharge passages becomes sufficiently high, whereby atomization of the paint is reliably facilitated.

(4) A rotary atomization coating method in which paint is supplied from a paint feed tube to an inner bottom of a bell-cup shaped rotary atomizing head that receives a high voltage applied and rotates at a high speed, and the paint is caused to flow along an inner peripheral surface of a cup of the rotary atomizing head and is released in an atomized form from a tip of the rotary atomizing head is characterized by including: temporarily accumulating the paint flowing toward the tip of the rotary atomizing head in an annular dam portion provided on the inner peripheral surface of the cup of the rotary atomizing head and also having an annular wall body where the wall surface of the annular wall body is adapted to correspond with a plane that is orthogonal to an axis of the rotary atomizing head; and generating a liquid pressure in the paint accumulated in the dam portion by a centrifugal force so as to discharge the paint from a multiplicity of paint discharge passages provided in the dam portion so as to be evenly distributed in a circumferential direction.

Effects of the Invention

According to the present invention, paint adhering to an inner peripheral surface of a rotary atomizing head can be easily cleaned and removed in the entire region.

Moreover, even if the paint discharge amount from the rotary atomizing head is increased, the sprayed paint particles can be reduced to minute particles, whereby the coating quality can be improved.

Moreover, according to the rotary atomization coating apparatus and the rotary atomization coating method of the present invention, the rotational speed of the rotary atomizing head and the pressure of shaping air need not be increased even if the paint discharge amount is increased. Thus, desired coating efficiency and desired coating film quality can be ensured. Moreover, since the paint discharge amount can be increased, the number of coating robots that are installed in a coating line can be reduced, or the transfer speed can be increased, which significantly contributes to reduction in coating cost.

BRIEF DESCRIPTION OF THE DRAWINGS

FIG. 10A is a cross-sectional view, and FIG. 10B is a front view showing a tip of a rotary atomizing head in development; and FIG. 11 is a table showing the total effective sectional area of paint passages, obtained from the bore diameter and the number of paint passages as an example of the second embodiment of the present invention, and the ratio of the total effective sectional area to the diameter of a pitch circle in which the paint passages are arranged, and also showing, for reference, corresponding numerical values of common rotary atomizing heads that are conventionally commonly used for coating of automotive bodies, as reference examples.

DESCRIPTION OF THE REFERENCE NUMERALS

Figure 1:
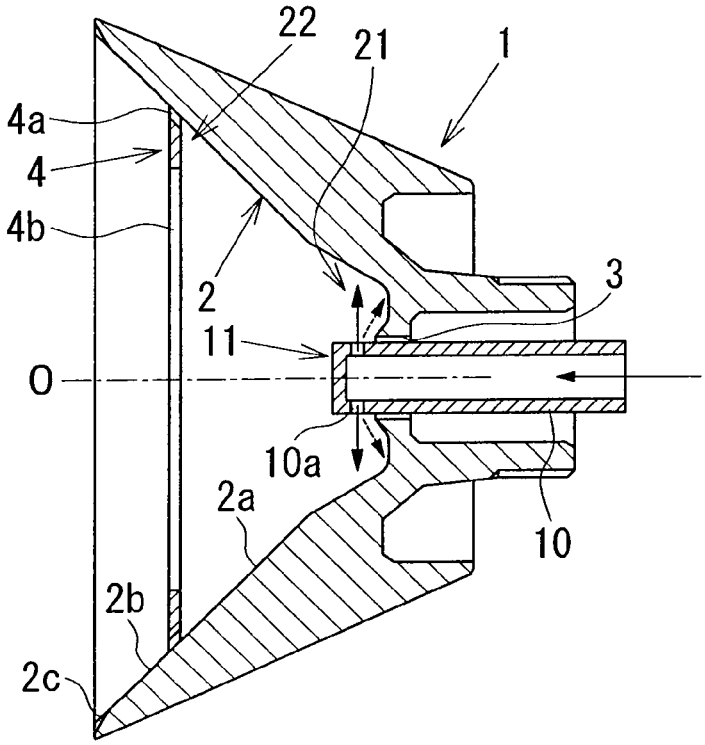
FIG. 1 is a side cross-sectional view of a rotary atomizing head according to a first embodiment of the present invention.

1 rotary atomizing head
2 inner peripheral surface
2*a* bottom-side paint path
2*b* tip-side paint path
2*c* paint releasing end
4 dam portion
4*a* paint supply hole
4*b* opening
10 paint supply tube
10*a* nozzle hole
11 paint supply nozzle
21 bottom

22 paint reservoir portion
210 rotary atomizing head
211 motor
212 paint feed tube
216 hollow rotary shaft
220 hub
223 paint supply passage around the hub
224 paint
225 inner peripheral surface of a cup of the rotary atomizing head
226 paint releasing end (a tip of the rotary atomizing head)
227 dam portion
228 annular wall body
229 paint discharge passage

BEST MODES FOR CARRYING OUT THE INVENTION

Modes for embodying the present invention will be described below with reference to the accompanying drawings.

First, a first embodiment of the present invention will be described below.

Figure 2:
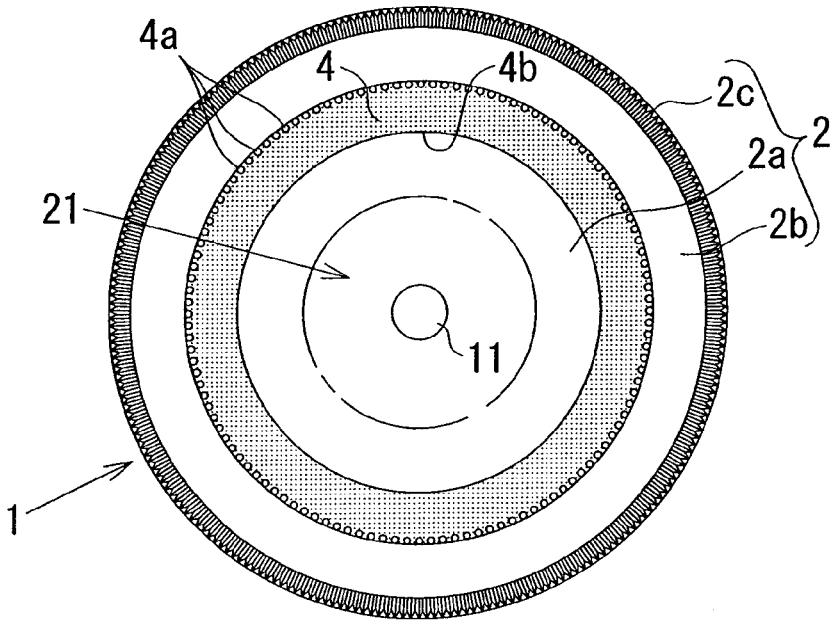
FIG. 2 is a front view of the rotary atomizing head according to the first embodiment of the present invention.

A rotary atomizing head 1 shown in FIGS. 1 and 2 is included in a rotary atomization coating apparatus for electrostatically coating an object to be coated, and is rotatably mounted to a coating apparatus main body, not shown, of the rotary atomization coating apparatus.

The rotary atomizing head 1 has an inner peripheral surface 2 formed in a bottomed bell shape, and the diameter of the inner peripheral surface 2 increases from a bottom 21 (the right end in FIG. 1) of the inner peripheral surface 2 toward a tip thereof (toward the left end in FIG. 1). Moreover, the tip of the inner peripheral surface 2 forms a paint releasing end 2*c*.

Moreover, a base of the rotary atomizing head 1 is rotatably supported by the coating apparatus main body, and the rotary atomizing head 1 is rotatable about a rotation axis 0.

Note that, in this example, the right end side of the rotary atomizing head 1 in FIG. 1 is a base side, and the left end side thereof is a tip side.

A communication hole 3 for providing communication between the bottom 21 and the base side of the rotary atomizing head 1 is formed in the bottom 21 of the inner peripheral surface 2 of the rotary atomizing head 1 so as to be coaxial with the rotation axis 0, and a paint supply tube 10 is inserted into the communication hole 3 from the base side of the rotary atomizing head 1.

The paint supply tube 10 is formed by a tubular member having a tip side closed, and the tip portion of the paint supply tube 10 protrudes from the bottom 21 of the inner peripheral surface 2.

Moreover, a plurality of nozzle holes 10*a*, 10*a*, . . . are formed on the side surface of the portion of the paint supply tube 10 which protrudes from the bottom 21, and a paint supply nozzle 11 is formed by the portion of the paint supply tube 10 which protrudes from the bottom portion 21.

A base end of the paint supply tube 10 is connected to the coating apparatus main body, and paint in a paint tank that is mounted to the coating apparatus main body is supplied to the paint supply nozzle 11 through the paint supply tube 10, and is discharged from the nozzle holes 10*a*, 10*a*, . . . of the paint supply nozzle 11 to the bottom 21 of the inner peripheral surface 2.

The nozzle holes 10*a*, 10*a*, . . . are formed in a direction substantially perpendicular to the rotation axis 0, or in a direction tilted toward the base from the direction substantially perpendicular to the rotation axis 0. The paint discharged from the nozzle holes 10*a*, 10*a*, . . . flows from a central part of the bottom 21 toward a radially outward direction (the direction shown by solid arrows in FIG. 1) or a radially outward direction tilted toward the base (the direction shown by dotted arrows in FIG. 1), and reaches the inner peripheral surface 2.

Moreover, a dam portion 4 is formed at an intermediate position between the bottom 21 of the inner peripheral surface 2 and the paint releasing end 2*c*.

The dam portion 4 is formed by an annular member, which is formed along a circumferential direction of the inner peripheral surface 2 and extends from the inner peripheral surface 2 in a direction substantially perpendicular to the rotation axis 0, and an opening 4*b* is formed in the center.

Moreover, a portion of the inner peripheral surface 2, which is located on the bottom 21 side of the dam portion 4, forms a bottom-side paint path 2*a*, and a portion of the inner peripheral surface 2, which is located on the tip side of the dam portion 4, forms a tip-side paint path 2*b*.

Moreover, the space surrounded by the dam portion 4 and the bottom-side paint path 2*a* is structured as a paint reservoir portion 22 where the paint is accumulated as the paint supplied to the bottom 21 flows toward the tip.

Moreover, a plurality of paint supply holes 4*a*, 4*a*, . . . are formed in a circumferential direction in a boundary portion of the dam portion 4 with the inner peripheral surface 2. The bottom-side paint path 2*a* and the tip-side paint path 2*b* communicate with each other through the paint supply holes 4*a*.

In the rotary atomizing head 1 structured as described above, when the paint is supplied from the paint supply nozzle 11 to the bottom 21 in a state where the rotary atomizing head 1 is rotating at a high speed, the paint supplied to the bottom 21 flows toward the tip through the bottom-side paint path 2*a* by a centrifugal force generated by the rotation.

Figure 3:
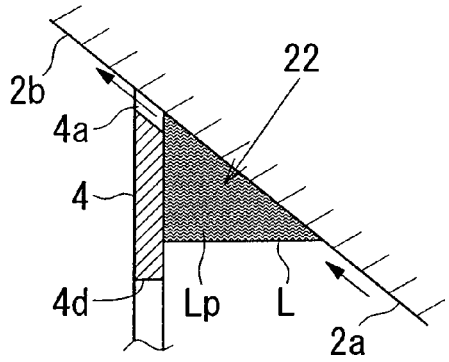
FIG. 3 is a side cross-sectional view of a portion of the rotary atomizing head where a dam portion is formed, showing a state where paint is accumulated in the dam portion according to the first embodiment of the present invention.

As shown in FIG. 3, when paint $L_p$ flowing from the bottom 21 toward the tip through the bottom-side paint path 2*a* reaches a portion where the dam portion 4 is formed, the paint $L_p$ is dammed by the dam portion 4, and is accumulated in the paint reservoir portion 22.

The paint accumulated in the paint reservoir portion 22 flows to the tip-side paint path 2*b* through the paint supply holes 4*a*, 4*a*, . . . , and then, is released from the paint releasing end 2*c* of the inner peripheral surface 2.

Figure 4:
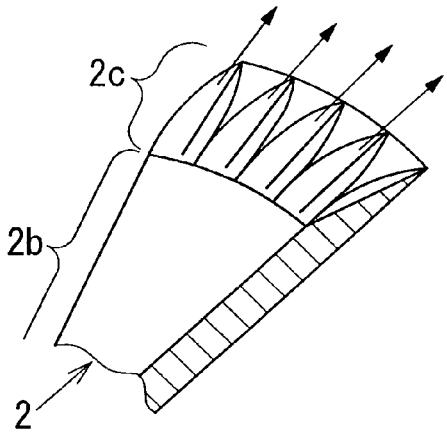
FIG. 4 is a perspective view showing serrations formed at a paint releasing end of an inner peripheral surface in the rotary atomizing head according to the first embodiment of the present invention.

As shown in FIG. 4, a plurality of serrations (groove portions) are formed in the paint releasing end 2*c* in a flowing direction of the paint. As the paint flowing through the tip-side paint path 2*b* passes the paint releasing end 2*c*, the paint to be released turns into liquid ligaments by the serrations, and is atomized after being released.

Moreover, the rotary atomization coating apparatus performs coating of the surface of an object to be coated, by applying an electrostatic high voltage to the rotary atomizing head 1 to charge atomized paint particles to be released, and spraying the charged paint particles, which is released from the paint releasing end 2*c*, toward the object by an electrostatic field formed between the rotary atomizing head 1 to which the electrostatic high voltage has been applied, and the grounded object.

Note that, during coating operation in which the rotary atomizing head 1 rotates at a high speed, the rotary atomization coating apparatus controls the paint supply amount from the paint supply nozzle 11, and the rotational speed of the rotary atomizing head 1 so that the paint is accumulated in the paint reservoir portion 22 in such a range that a liquid level L of the accumulated paint does not exceed an inner peripheral edge 4*d* of the dam portion 4.

That is, if the amount of the paint accumulated in the paint reservoir portion 22 is too large that the liquid level L of the paint is located on the inner peripheral side of the inner peripheral edge 4*d* of the dam portion 4, the accumulated paint flows over the inner peripheral edge 4*d* into the tip-side paint path 2*b* through the opening 4*b* of the dam portion 4, whereby the coating quality is degraded. Thus, the amount of the paint that is accumulated is controlled in such a range that the liquid level L of the paint does not exceed the inner peripheral edge 4*d* of the dam portion 4.

Moreover, the paint dammed by the dam portion 4 and accumulated in the paint reservoir portion 22 has a liquid pressure against the inner peripheral surface 2 due to the centrifugal force generated by the rotation of the rotary atomizing head 1, and thus, is discharged at a high speed from the paint supply holes 4*a*, 4*a*, . . . .

That is, the paint that is accumulated in the paint reservoir portion 22 is subjected to a centrifugal force F represented by the following equation 1.

$$F=mR\omega^2 \quad \text{(Equation 1)}$$

Note that, in equation 1, m indicates the mass of the paint accumulated in the paint reservoir portion 22, R indicates a mean diameter of the paint accumulated in the paint reservoir portion 22 from the rotation axis 0, and ω indicates an angular velocity of the rotary atomizing head 1.

Thus, the paint accumulated in the paint reservoir portion 22 is subjected to a liquid pressure P represented by the following equation 2.

$$P=F/\Sigma S \quad \text{(Equation 2)}$$

Note that, in equation 2, ΣS indicates the area of a pressure-receiving region in the bottom-side paint path 2*a* of the inner peripheral surface 2.

Since the liquid pressure P is applied to the paint accumulated in the paint reservoir portion 22, the paint is discharged at a high speed from the paint supply holes 4*a*, 4*a*, . . . .

Thus, the paint discharged at a high speed from the paint supply holes 4*a*, 4*a*, . . . is released at a higher speed from the paint releasing end 2*c*, as compared to the case where the paint is released without being accumulated in the paint reservoir portion 22. Thus, the diameter of the paint that is released in the form of liquid ligaments can be reduced, whereby high minuteness of the sprayed paint can be achieved.

Thus, even if the paint discharge amount from the rotary atomizing head 1 is increased, the sprayed paint particles can be reduced to minute particles, whereby the coating quality can be improved.

Moreover, in this rotary atomization coating apparatus, the amount of the paint that is dammed by the dam portion 4 and accumulated in the paint reservoir portion 22 can be controlled by the rotational speed of the rotary atomizing head 1 and the paint supply amount from the paint supply nozzle 11. Thus, the discharge speed can be adjusted by controlling the liquid pressure of the paint accumulated in the paint reservoir portion 22, whereby the rotary atomization coating apparatus can be adapted to various coating specifications. Such mode will be described in detail later in a second embodiment of the present embodiment.

Note that, in the inner peripheral surface 2, the position where the dam portion 4 is provided in the rotation axis 0 direction can be any appropriate position between the bottom 21 of the inner peripheral surface 2 and the paint releasing end 2*c*. However, from the standpoint of applying a high liquid pressure to the paint accumulated in the paint reservoir portion 22, it is desirable to provide the dam portion 4 at a position close to the paint releasing end 2*c* where the diameter R of the accumulated paint from the rotation axis 0 is increased.

Figure 9:
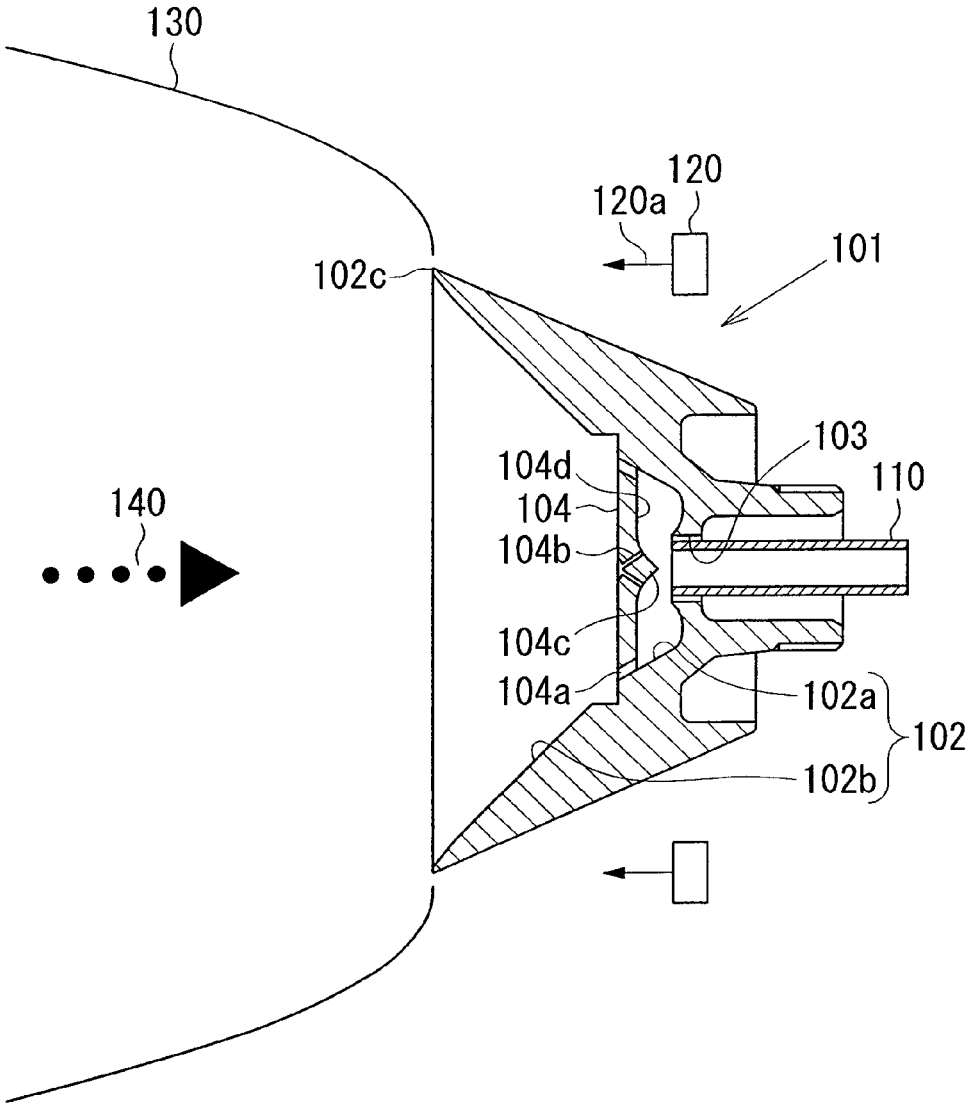
FIG. 9 is a side cross-sectional view of a conventional rotary atomizing head.

Moreover, this example was described with respect to the structure in which the dam portion 4 is provided in the rotary atomizing head in which the bottom 21 of the inner peripheral surface 2 is not closed by a hub portion. However, even in a rotary atomizing head 101 in which a hub portion 104, which closes a paint reservoir chamber 102*a* formed at the bottom of an inner peripheral surface 102, is provided as shown in FIG. 9, the dam portion 4 may be provided between the hub portion 104 and a paint releasing end 102*c*.

In this case as well, the paint can be released at a high speed, and the diameter of the paint that is released in the form of liquid ligaments can be reduced, whereby high minuteness of the sprayed paint can be achieved.

Thus, even when the paint discharge amount from the rotary atomizing head 1 is increased, the sprayed paint particles can be reduced to minute particles, whereby the coating quality can be improved.

Moreover, the rotary atomization coating apparatus is capable of discharging a cleaning solution from the paint supply nozzle 11 to the bottom 21, and thus, is capable of cleaning the rotary atomizing head 1 by the cleaning solution discharged to the bottom 21.

That is, when the cleaning solution is discharged from the paint supply nozzle 11 to the bottom 21 in the state where the rotary atomizing head 1 is rotating at a high speed, the cleaning solution supplied to the bottom 21 flows toward the tip through the bottom-side paint path 2*a* by a centrifugal force generated by the rotation.

When a cleaning solution $L_w$, which flows from the bottom 21 toward the tip through the bottom-side paint path 2*a*, reaches the portion where the dam portion 4 is formed, the cleaning solution $L_W$ is dammed by the dam portion 4 and accumulated in the paint reservoir portion 22, as in the case of the paint described above.

The cleaning solution accumulated in the paint reservoir portion 22 flows to the tip-side paint path 2*b* through the paint supply holes 4*a*, 4*a*, . . . , and then, is released from the paint releasing end 2*c* of the inner peripheral surface 2.

Thus, the cleaning solution supplied to the bottom 21 cleans and removes the paint adhering to the bottom-side paint path 2*a*, the paint supply holes 4*a*, 4*a*, . . . , and the tip-side paint path 2*b*, as the cleaning solution flows toward the tip along the bottom-side paint path 2*a*, the paint supply holes 4*a*, 4*a*, . . . , and the tip-side paint path 2*b*.

Moreover, since the cleaning solution is accumulated in the paint reservoir portion 22, the bottom 21-side side surface of the dam portion 4 is cleaned by the accumulated cleaning solution.

As in the case of performing coating by conventional rotary atomization coating apparatuses, in the case of performing coating by this rotary atomization coating apparatus, an accompanying flow is generated in the direction from the tip side of the rotary atomizing head 1 toward the base thereof, and the released paint particles move with the accompanying flow.

The paint particles, moving with the accompanying flow, first adhere to the tip-side paint path 2*b*, and then, to the bottom-side paint path 2*a* through the opening 4*b* of the dam portion 4. However, since the paint constantly flows in the tip-side paint path 2*b* and the bottom-side paint path 2*a* during coating operation, the paint particles do not dry even if the paint particles, which move with the accompanying flow, adhere thereto. Thus, cleaning operation is not specifically troublesome.

That is, the conventional rotary atomizing head 101 has the hub portion 104 in order to cause the paint, which is supplied from the paint supply tube 110 to the paint reservoir chamber 102*a*, to flow toward the outer periphery, and the paint particles dry after adhering to the front surface of the hub portion 104 where the paint does not flow. Thus, it takes time to perform cleaning operation.

However, since the rotary atomizing head 1 has the paint supply nozzle 11 for discharging the paint radially outward from the central part of the bottom 21, the hub portion 104, which is a portion where the paint particles adhering thereto dry, need not be provided as in the conventional example, and the bottom-side paint path 2*a* where the paint constantly flows is the portion to which the paint particles adhere near the bottom 21 of the inner peripheral surface 2.

Thus, the paint adhering to the inner peripheral surface 2 can be easily cleaned and removed in the entire region.

Moreover, this rotary atomization coating apparatus is structured to clean also the tip-side side surface of the dam portion 4 in the manner described below, when performing cleaning operation by discharging the cleaning solution from the paint supply nozzle 11.

Figure 5:
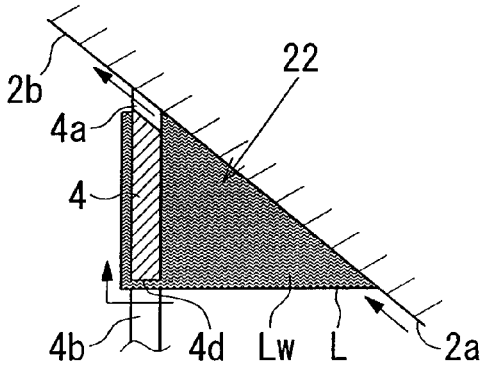
FIG. 5 is a side cross-sectional view showing a state where a cleaning solution accumulated in the dam portion overflows from an inner peripheral edge of the dam portion toward a tip thereof according to the first embodiment of the present invention.

That is, as shown in FIG. 5, when the cleaning solution is supplied from the paint supply nozzle 11 to clean the rotary atomizing head 1, the liquid level L of the cleaning solution accumulated in the paint reservoir portion 22 is controlled so as to be located on the inner peripheral side of the inner peripheral edge 4*d* of the dam portion 4.

Thus, since the cleaning solution is accumulated in the paint reservoir portion 22 so that the liquid level L is located on the inner peripheral side of the inner peripheral edge 4*d* of the dam portion 4, the accumulated cleaning solution flows over the inner peripheral edge 4*d* toward the tip-side paint path 2*b* through the opening 4*b* of the dam portion 4, whereby the cleaning solution flows from the inner peripheral edge 4*d* along the tip-side side surface of the dam portion 4, and thus, flows from the inner peripheral side toward the outer peripheral side.

The tip-side side surface of the dam portion 4 is thus cleaned by the cleaning solution flowing along the tip-side side surface of the dam portion 4.

In this case, by controlling the cleaning solution supply amount from the paint supply nozzle 11, and the rotational speed of the rotary atomizing head 1, the amount of the cleaning solution accumulated in the paint reservoir portion 22 is adjusted so that the liquid level L is located on the inner peripheral side of the inner peripheral edge 4*d* of the dam portion 4.

As described above, in the case of cleaning the rotary atomizing head 1 by supplying the cleaning solution from the paint supply nozzle 11, the amount of the cleaning solution accumulated in the paint reservoir portion 22 is adjusted so that the liquid level L is located on the inner peripheral side of the inner peripheral edge 4*d* of the dam portion 4. Thus, the tip-side surface of the dam portion 4 is cleaned, whereby the paint adhering thereto can be removed.

In this case, the cleaning solution that flows on the tip-side surface of the dam portion 4 is supplied from the inner peripheral edge 4*b* extending along the entire circumference of the dam portion 4, and the supply amount thereof can be adjusted as appropriate. Thus, by normal cleaning operation in which the rotary atomizing head 1 is drivingly rotated while supplying the cleaning solution from the paint supply nozzle 11, a large amount of cleaning solution is supplied to the tip-side surface of the dam portion 4, whereby the paint adhering to the tip-side surface of the dam portion 4 can be easily cleaned and removed in a short period of time.

Next, the second embodiment of the present invention will be described.

Figure 6:
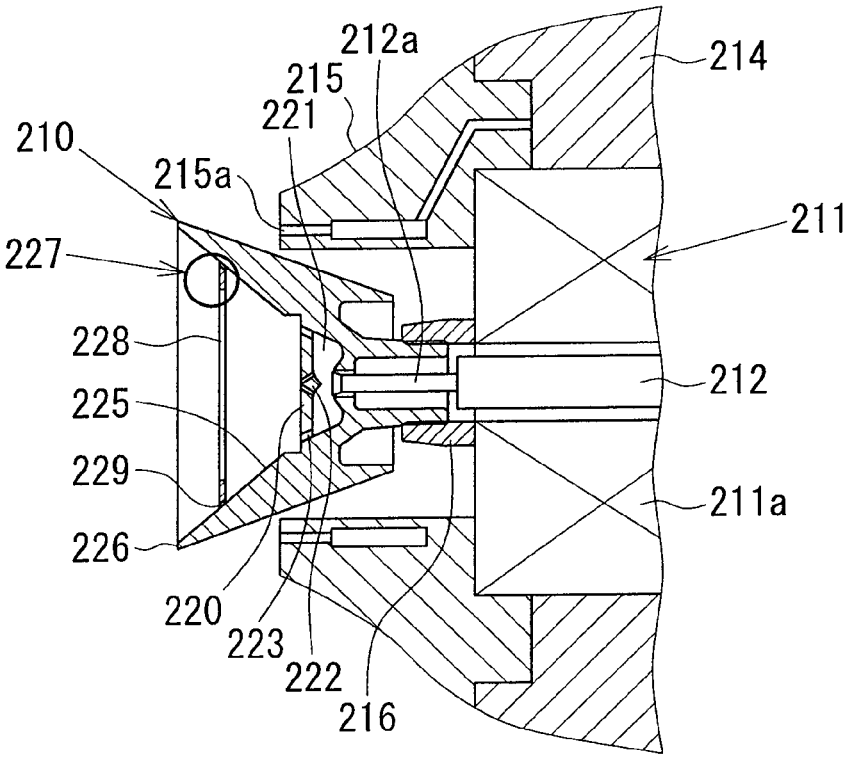
FIG. 6 is a cross-sectional view showing the structure of a main part of a rotary atomization coating apparatus according to a second embodiment of the present invention.
Figure 7:
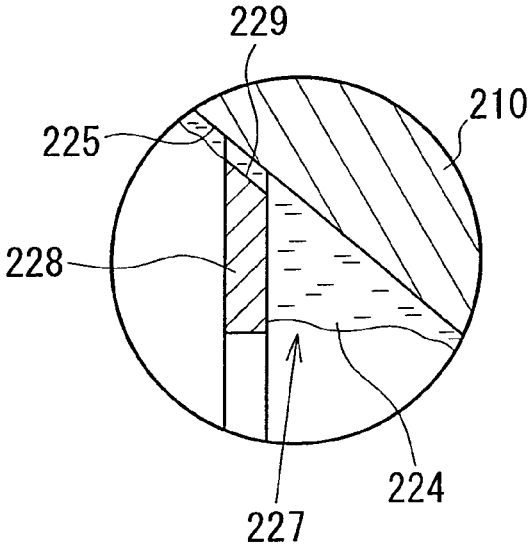
FIG. 7 is a cross-sectional view showing a detailed structure of a dam portion in the rotary atomization coating apparatus according to the second embodiment of the present invention.

FIGS. 6 and 7 show the structure of a main part of a rotary atomization coating apparatus according to the present invention. This rotary atomization coating apparatus includes a bell-cup shaped rotary atomizing head 210, a motor 211 for drivingly rotating the rotary atomizing head 210, a paint feed tube 212 for supplying paint to the rotary atomizing head 210, and a high voltage generator (not shown) for generating a high voltage to be applied to the motor 211. The motor 211, the paint feed tube 212, and the high voltage generator are collectively accommodated in an insulating coating machine main body 214 having an attachment portion to a coating robot at a rear end thereof. This rotary atomization coating apparatus further includes a ring member 215 having a plurality of air discharging ports 215*a* for discharging shaping air from behind the rotary atomizing head 210 toward the periphery thereof. The ring member 215 is connected to a front end of the coating machine main body 214.

The motor 211 is herein formed by an air motor, and a hollow rotation shaft 216, which is as an output shaft of the motor 211, is extended forward from a motor casing 211*a*. A female screw is formed at the tip of the hollow rotation shaft 216, and the rotary atomizing head 210 is screwed into the tip of the rotation shaft 216. The motor casing 211*a* is made of a metal, and an electrostatic high voltage (e.g., −90 kV) is supplied from the high voltage generator through an inner cable to the motor casing 211*a*. The paint feed tube 212 is inserted through the hollow rotation shaft 216 of the motor 211, and a nozzle portion 212*a* at the tip of the paint feed tube 212 is inserted in the inner bottom of the rotary atomizing head 210.

The inner bottom of the rotary atomizing head 210 is partitioned by a disc-shaped hub 220, and the nozzle portion 212*a* of the paint feed tube 212 is introduced into a chamber 221 partitioned by the hub 220. The hub 220 has a center cone 222 in the center of a back surface thereof, and the center cone 222 faces straight toward the nozzle portion 212*a*. The hub 220 further has a multiplicity of paint supply passages 223 that are evenly distributed in a circumferential direction in a junction portion with the inner surface of the rotary atomizing head 210. Paint 224 (FIG. 7), supplied from the paint feed tube 212 to the rotary atomizing head 210, collides with the center cone 222 on the back surface of the hub 220 and diffuses to the periphery, and then, is supplied to an inner peripheral surface (a paint passage surface) 225 of a cup on the front side of the rotary atomizing head 210 through the paint supply passages 223. At this time, since the rotary atomizing head 210 rotates at a high speed, the paint 224 supplied to the inner peripheral surface 225 of the cup is subjected to a centrifugal force, whereby the paint 224 flows along the inner peripheral surface 225 of the cup toward a tip (a paint releasing end) 226 of the rotary atomizing head 210. A multiplicity of V grooves 102*d* (FIG. 10) are formed in the paint releasing end 226 of the rotary atomizing head 210 in the manner described above, and the paint 224 is released through the V grooves 102*d*.

A dam portion 227 for accumulating the paint 224 flowing along the inner peripheral surface 225 of the cup is provided on the inner peripheral surface 225 of the cup of the rotary atomizing head 210. The dam portion 227 is herein formed by an annular wall body 228 whose wall surface corresponds to a plane perpendicular to the axis of the rotary atomizing head 210, and the outer periphery of the annular wall body 228 is connected to the inner peripheral surface 225 of the cup of the rotary atomizing head 210. However, a multiplicity of paint discharge passages 229 are provided in the joint portion of the annular wall body 228 with the inner peripheral surface 225 of the cup of the rotary atomizing head 210 so as to be evenly distributed in a circumferential direction. Since the rotary atomizing head 210 rotates at a high speed, the paint 224 accumulated in the dam portion 227 is subjected to a centrifugal force, and this centrifugal force generates a liquid pressure in the paint 224 in the dam 227. Then, the paint 224 is discharged at a high speed from the paint discharge passages 229 by this liquid pressure, and flows toward the paint releasing end 226 while maintaining the high speed.

Note that the motor 211 for rotating the rotary atomizing head 210 may be of any type, and a hydraulic motor, an electric motor, or the like may be used instead of the air motor described above.

When electrostatic coating is performed by the rotary atomization coating apparatus, the rotary atomizing head 210 is rotated at a high speed by the motor 211 while applying an electrostatic high voltage, which is generated by the high voltage generator (not shown), to the casing 211*a* of the motor 211, and the paint is fed from a paint supply source to the rotary atomizing head 210 through the paint feed tube 212. Then, the paint 224 flows from the back side of the hub 220 to the inner peripheral surface 225 of the cup of the rotary atomizing head 210 through the paint supply passages 223, and flows along the inner peripheral surface 225 of the cup toward the paint releasing end 226.

Since the dam portion 227 is provided at an intermediate position on the inner peripheral surface 225 of the cup, the paint flowing toward the paint releasing end 226 is temporarily accumulated in the dam portion 227. In this case, since the dam portion 227 is formed by the annular wall body 228 whose wall surface corresponds to the plane perpendicular to the axis of the rotary atomizing head 210, overflow of the paint 224 from the dam portion 227 is suppressed, and the paint 224 is intensively accumulated in the dam portion 227. Since the paint 224 accumulated in the dam portion 227 is subjected to a centrifugal force generated by the high-speed rotation of the rotary atomizing head 210, a liquid pressure is generated in the paint 224 in the dam portion 227, and the paint 224 is discharged at a high speed from the paint discharge passages 229 by this liquid pressure. In this case, the paint discharge passages 229 are provided in the joint portion between the annular wall body 228 and the inner peripheral surface 225 of the cup of the rotary atomizing head 210, that is, in a portion that corresponds to the bottom of the dam portion 227 and where the centrifugal force acts the most. Thus, the paint 224 is forced out at a high pressure from the paint discharge passages, and the paint is accelerated efficiently, whereby the paint discharge speed becomes sufficiently high. Then, the paint 224 discharged from the paint discharge passages 229 flows toward the paint releasing end 226 while maintaining the high speed, and is released at a high speed from the V grooves 102*d* formed in the paint releasing end 226.

Figure 10:
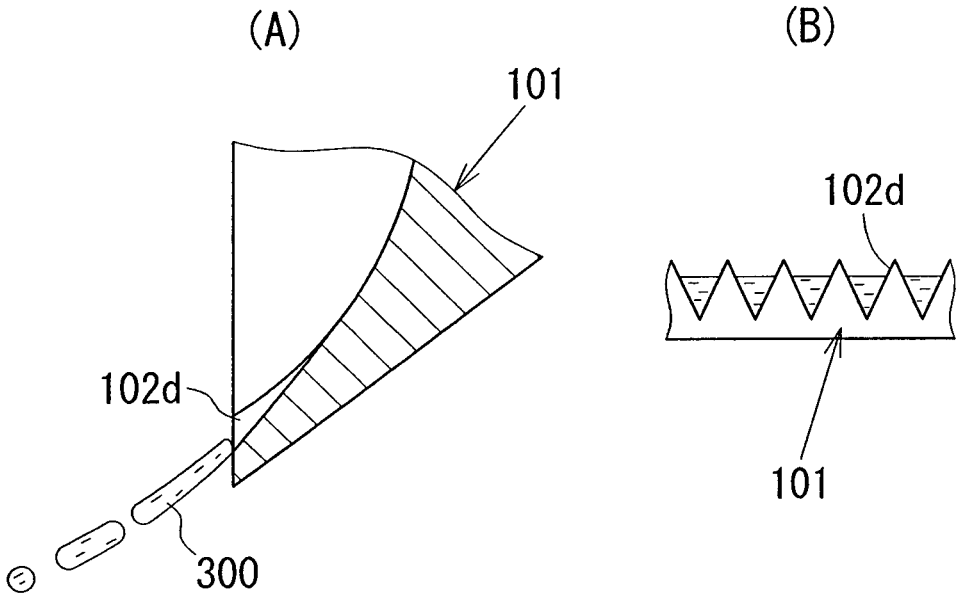
FIG. 10 schematically shows a mechanism of atomizing paint by a rotary atomization coating apparatus, where

The paint 224 released from the V grooves 102*d* of the paint releasing end 226 is released in the state of liquid ligaments 300 as shown in FIG. 10 mentioned above, and then, is divided and atomized. In the present embodiment, since the paint 224 is released at a high speed from the paint releasing end 226, the liquid ligaments 300 are released in a thin state. In other words, even if the paint discharge amount from the rotary atomizing head 210 is increased, the thickness of the liquid ligaments 300 can be prevented from increasing, and as a result, atomization of the paint proceeds smoothly, whereby desired coating film quality is obtained. Moreover, since the rotational speed of the rotary atomizing head 210 need not be increased, a variation in particle size distribution of the atomized coating particles is suppressed. Moreover, since the pressure of the shaping air from the ring member 215 need not be increased, desirable coating film quality and desirable coating efficiency can be obtained.

The thickness (the diameter) of the liquid ligaments 300 required to obtain ideal particle size distribution is approximately determined (e.g., about 30 μm). Moreover, the paint discharge amount from the rotary atomizing head 210 is determined by the diameter of the liquid ligaments 300 and the paint releasing speed, and thus, the paint releasing speed required to obtain the liquid ligaments 300 having an ideal thickness is determined if a target paint discharge amount is determined. On the other hand, the paint releasing speed depends on the liquid pressure that is generated in the paint 224 accumulated in the dam portion 227. Thus, by appropriately controlling this liquid pressure, the target paint discharge amount can be obtained while maintaining the size of the liquid ligaments 300 in an ideal state. In this case, provided that the rotational speed of the rotary atomizing head 210 and the diameter of the dam portion 227 are constant, the liquid pressure that is generated in the paint 224 in the dam portion 227 is determined by the mass of the paint 224 accumulated in the dam portion 227. Thus, by setting the height of the dam portion 227 (the annular wall body 228) according to the target paint discharge amount, the paint discharge amount can be increased while assuring desired coating film quality and desired coating efficiency.

Example 1

Rotary atomizing heads (outer diameter: 70 mm) according to invention 1 and invention 2 were fabricated by changing the position of the dam portion 27 provided on the inner peripheral surface 225 of the cup of the rotary atomizing head 210, and the number of paint discharge passages 229 in the rotary atomization coating apparatus of FIG. 6, as shown in FIG. 11. Then, with the rotational speed of the rotary atomizing heads being set to 25,000 rpm, atomization experiments for atomizing the paint were performed, and the particle size distribution was obtained by measuring the particle size of atomized coating particles by a particle size analyzer. Moreover, for comparison, similar atomization experiments were performed for comparative example 1 which is an existing rotary atomizing head having no dam portion 227 in the rotary atomizing head 210 of FIG. 6.

FIG. 11 herein is a table showing the total effective sectional area S of paint passages (S=the bore diameter of the paint passages× the number of paint passages), obtained from the bore diameter and the number of paint passages (in inventions 1 and 2, the paint discharge passages 229 provided in the dam portion 227, and in comparative example 1, the paint supply passages 223 provided in the hub 220), and also showing the ratio (the S/D ratio) of the total effective sectional area S to the diameter D of a pitch circle in which the paint passages are arranged (in this case, the diameter D is substantially equal to the diameter of the dam portion 227 and the diameter of the hub 220). This table also shows, for reference, corresponding numerical values of common rotary atomizing heads that are conventionally commonly used for coating of automotive bodies, as reference examples 1 and 2.

Referring to the table of FIG. 11, the S/D ratio of inventions 1 and 2 is 0.3 or less, while the S/D ratio of conventional comparative example 1 and reference examples 1 and 2 is 1.0 or more. Thus, a large difference in S/D ratio is recognized between the rotary atomizing heads of the present invention, and the conventional rotary atomizing heads.

Figure 8:
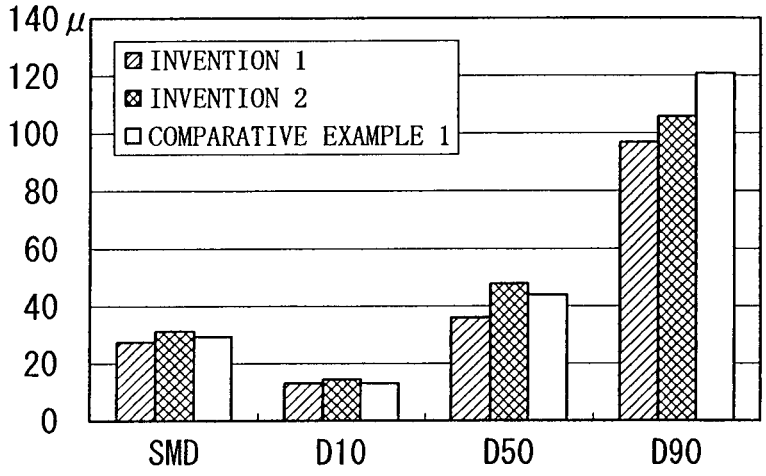
FIG. 8 is a graph showing the result of atomization experiments as an example of the second embodiment of the present invention, in comparison with a comparative example.

FIG. 8 shows the result of the above atomization experiments. In FIG. 8, SMD indicates a mean particle size, and D10, D50, and D90 indicate particle sizes in the case of the volume cumulative distribution of 10%, 50%, and 90%, respectively. Thus, in the mean particle size SMD and the volume cumulative distribution D10 and D50, there is no significant difference in particle size between inventions 1 and 2, and comparative example 1. In the volume cumulative distribution D90, however, it is apparent that the particle size is smaller in the present invention than in the comparative example. This means that the amount of coating particles in the region of a large particle size (a coarse particle region) is reduced when using the rotary atomizing head of the present invention, and the effect obtained by providing the dam portion 217 is obvious. In this case, the difference in structure between the present invention and the comparative example appears significantly in the S/D ratio shown in the above table of FIG. 11, and this shows that it is desirable to set the bore diameter, the number, and the pitch circle diameter of the paint passages so that the S/D ratio becomes 0.5 or less, and desirably, 0.3 or less.

The invention claimed is:

1. A rotary atomization coating apparatus, the rotary atomization coating apparatus comprising:

a rotary atomizing head that has an inner peripheral surface whose diameter increases from a bottom of the inner peripheral surface toward a tip thereof, and atomizes and releases paint by applying a centrifugal force generated by rotation to the paint supplied to the bottom of the inner peripheral surface;

a paint supply nozzle for supplying the paint and a cleaning solution to a bottommost portion of the inner peripheral surface to maximize effects of the centrifugal force, wherein the paint supply nozzle has a nozzle hole for discharging the paint and the cleaning solution from a rotation center portion of the rotary atomizing head in a direction substantially perpendicular to a rotation axis of the rotary atomizing head;

a dam portion that is provided adjacent the tip of the inner peripheral surface, and dams the paint and the cleaning solution supplied from the paint supply nozzle to the bottom to maximize effects of the centrifugal force, the paint and the cleaning solution being adapted to flow along the inner peripheral surface toward the tip, wherein the dam portion is a single annular member formed along a circumferential direction of the inner peripheral surface and also has an annular wall body where the wall surface of the annular wall body is adapted to correspond with a plane that is orthogonal to an axis of the rotary atomizing head; and a plurality of paint supply holes formed in the circumferential direction in a boundary portion of the dam portion with the inner peripheral surface, the plurality of paint supply holes configured to release paint that has been dammed by the dam portion and accumulated in a paint reservoir portion located between the dam portion and the inner peripheral surface;

wherein the rotary atomization coating apparatus is configured such that when the rotary atomizing head rotates, the rotary atomizing head rotates relative to the paint supply nozzle.

2. The rotary atomization coating apparatus according to claim 1, wherein respective amounts of the paint and the cleaning solution dammed by the dam portion in the rotary atomizing head are controlled by a rotational speed of the rotary atomizing head and respective supply amounts of the paint and the cleaning solution.

3. The rotary atomization coating apparatus according to claim 1, wherein respective amounts of the paint and the cleaning solution dammed by the dam portion in the rotary atomizing head are controlled by a rotational speed of the rotary atomizing head and respective supply amounts of the paint and the cleaning solution, and when the cleaning solution is supplied to the bottom of the inner peripheral surface, the rotational speed of the rotary atomizing head and the supply amount of the cleaning solution are controlled so that the cleaning solution dammed by the dam portion overflows from an inner peripheral edge of the dam portion toward the tip.

4. The rotary atomization coating apparatus according to claim 1, wherein the dam portion is located closer to the tip of the inner peripheral surface than to the bottom of the inner peripheral surface.

5. The rotary atomization coating apparatus according to claim 1, wherein the dam portion is separate from the paint supply nozzle.

* * * * *